US012600433B2

(12) United States Patent
Graf

(10) Patent No.: US 12,600,433 B2
(45) Date of Patent: Apr. 14, 2026

(54) TENDER WITH HYBRID CATAMARAN HULL CONFIGURATION

(71) Applicant: Aspen Power Catamarans LLC, Burlington, WA (US)

(72) Inventor: Lawrence J. Graf, Snohomish, WA (US)

(73) Assignee: Aspen Power Catamarans LLC, Burlington, WA (US)

( * ) Notice: Subject to any disclaimer, the term of this patent is extended or adjusted under 35 U.S.C. 154(b) by 463 days.

(21) Appl. No.: 18/106,687

(22) Filed: Feb. 7, 2023

(65) Prior Publication Data

US 2024/0262462 A1 Aug. 8, 2024

(51) Int. Cl.
*B63B 1/04* (2006.01)

(52) U.S. Cl.
CPC ..... *B63B 1/042* (2013.01)

(58) Field of Classification Search
CPC ... B63B 1/042; B63B 1/121; B63B 2001/186; B63B 1/20; B63B 2001/201
See application file for complete search history.

(56) References Cited

U.S. PATENT DOCUMENTS 3,051,115 A * 8/1962 Canazzi ..... B63B 1/20 114/61.32
3,067,711 A * 12/1962 Hesher ..... B63B 1/20 D12/312
3,225,729 A * 12/1965 Ewing, Jr. ..... B63B 1/20 114/271
3,239,856 A * 3/1966 Stannard ..... B63B 5/24 114/357
4,924,797 A * 5/1990 Solia ..... B63B 1/20 114/291
5,038,696 A * 8/1991 Athanasiou ..... B63B 1/20 114/291
5,125,352 A * 6/1992 Shields ..... B63B 1/04 114/61.33
5,419,274 A * 5/1995 van Diepen ..... B63B 1/18 D12/313
5,425,325 A * 6/1995 Washio ..... B63B 1/18 114/271
5,937,777 A * 8/1999 Azima ..... B63B 41/00 114/123
6,425,341 B1 * 7/2002 Devin ..... B63B 1/20 114/291
10,518,842 B1 * 12/2019 Kyle ..... B63B 1/20
2001/0001940 A1 * 5/2001 Robinson ..... B63B 1/042 114/290
2007/0261627 A1 * 11/2007 Davis ..... B63B 1/34 114/291
2009/0308300 A1 * 12/2009 Baker ..... B63B 1/042 114/288
2011/0232557 A1 * 9/2011 Kilgore ..... B63B 1/08 114/271

(Continued)

FOREIGN PATENT DOCUMENTS

GB 2481581 A * 1/2012 ..... B63B 1/042

*Primary Examiner* — Eldon T Brockman
(74) *Attorney, Agent, or Firm* — Christensen O'Connor Johnson Kindness PLLC

(57) ABSTRACT

A hybrid catamaran which includes a rigid mono hull with a plumb bow portion and a pair of catamaran sponsons positioned on opposing sides of the hull, beginning at a selected point along the hull from the bow, extending to the stern of the boat.

14 Claims, 6 Drawing Sheets

(56) References Cited

U.S. PATENT DOCUMENTS

| | | | | |
|---|---|---|---|---|
| 2012/0291686 | A1* | 11/2012 | Loui | B63B 1/20 114/291 |
| 2015/0336633 | A1* | 11/2015 | Guerard | B63B 1/042 114/274 |
| 2016/0090154 | A1* | 3/2016 | Read | B63B 1/125 114/61.1 |
| 2016/0207591 | A1* | 7/2016 | Loui | B63B 1/04 |

* cited by examiner

TENDER WITH HYBRID CATAMARAN HULL CONFIGURATION

TECHNICAL FIELD

This invention relates generally to boat hull configurations and more specifically to a hybrid catamaran hull configuration.

BACKGROUND OF THE INVENTION

Tenders, i.e., boats, in various sizes and hull configurations are well known, including some configurations with hulls and catamaran sponson sections. Typical designs, however, have known disadvantages, including stability issues in choppy seas, spray volume at speed, and often limited interiors volumes, depending on the overall size.

SUMMARY OF THE INVENTION

Accordingly, the hybrid catamaran, comprises a boat structure, having a rigid hull; wherein the rigid hull includes a plumb bow portion of the hull, extending vertically at least to the water line when the boat is on the water, wherein the hull extends rearwardly from the plumb bow in a mono hull configuration; and a pair of catamaran sponsons positioned on opposite sides of the hull, wherein the sponsons begin at a point approximately 20-30% from the plumb bow, extending to the stern of the boat.

BEST MODE FOR CARRYING OUT THE INVENTION

Figure 1:
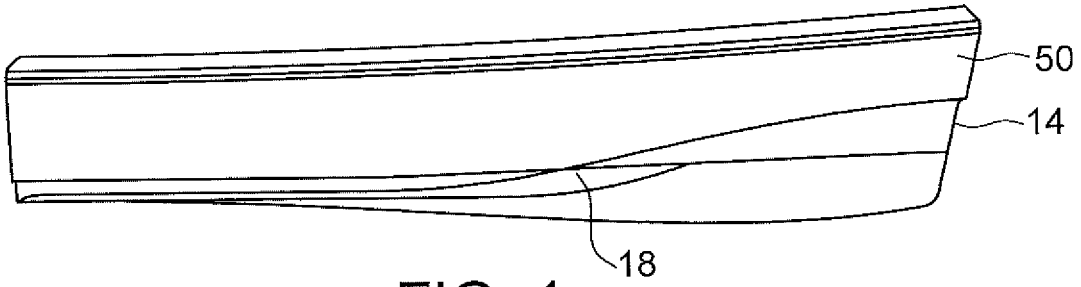
FIG. 1 is a profile view of the tender/boat of the present invention.
Figure 3:
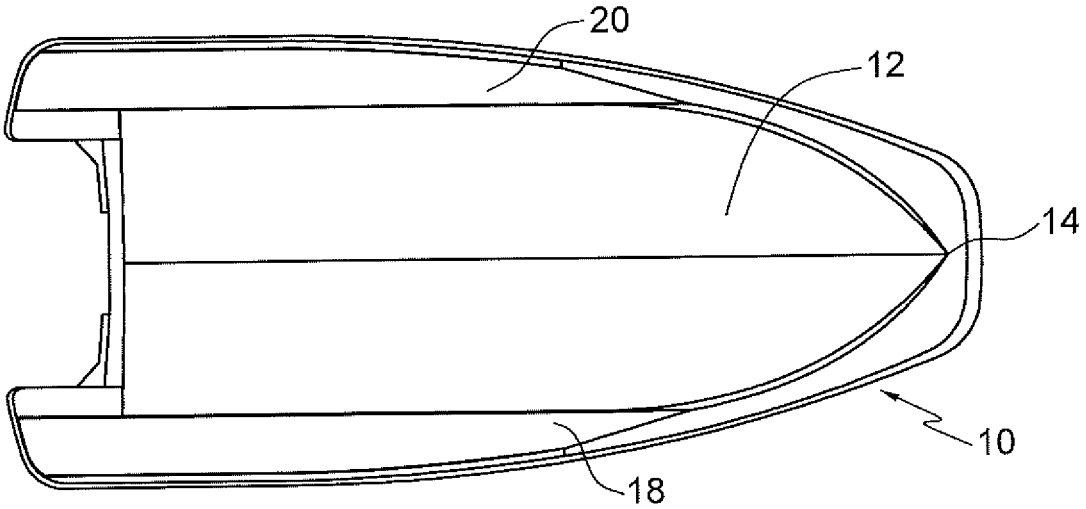
FIG. 3 is a bottom view of the tender.
Figure 4:
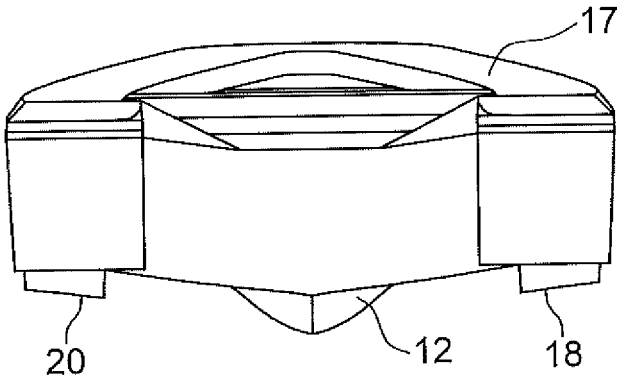
FIG. 4 is a bow view of the tender.

The tender of the present invention, referred also herein as a boat, shown in the various figures, has a rigid hull shape which combines a mono hull and aft located catamaran sponsons. The hull is shown generally in FIGS. 1, 2 and 3 with profile, top and bottom views respectively. FIGS. 4 and

Figure 2:
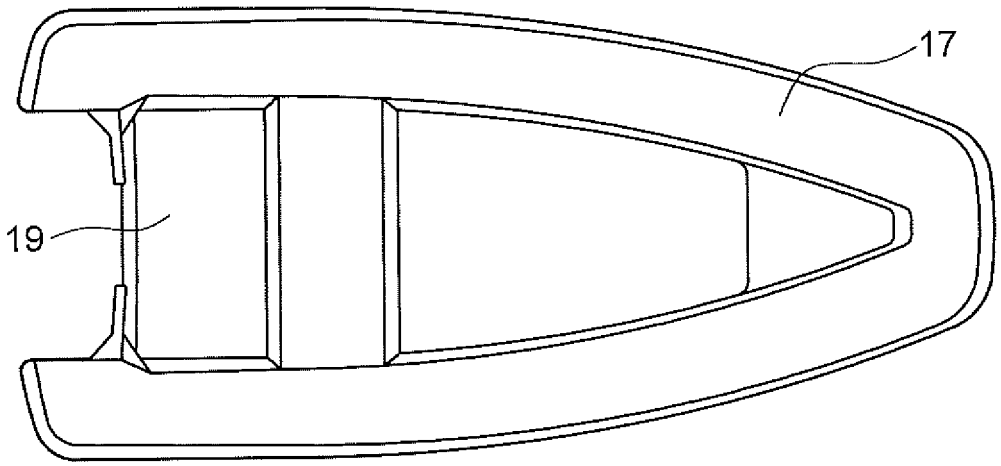
FIG. 2 is a top view of the tender.
Figure 5:
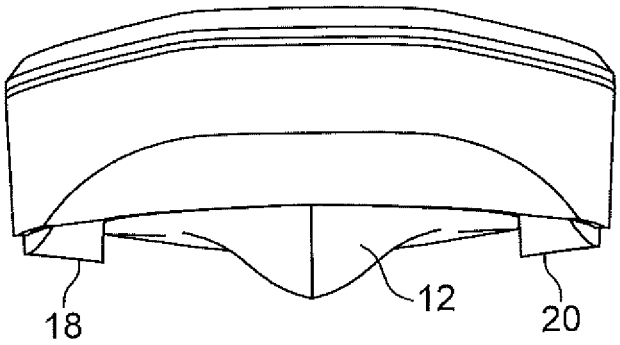
FIG. 5 is a stern view of the tender.

5 show bow and stern views of the tender. Although the description of the tender in this application is directed toward a tender with a length of approximately 11', it should be understood that hulls incorporating the present invention may take various sizes, including larger sizes, up to 20 and even 40 feet or more. The tender may have various configurations in addition to the particular tender configuration described herein. FIG. 2 is a top view of a preferred embodiment of the tender, which illustrates a roomy interior portion with clear floor and working areas, including a seating area 17 around the periphery of the tender. The top view shows a transom area 19 at the stern in which an outboard motor (not shown) with operator control can be positioned. As will be discussed in more detail below, the tender includes a particular rigid hull configuration which combines a central mono hull, with catamaran sponsons on opposing sides of the hull extending aft from a selected point along the length of the hull. The catamaran sections are shown most clearly in FIGS. 4-6. Generally, the forward end of the tender is a mono hull with a plumb bow. The mono hull extends rearwardly of the tender for approximately 85-92% of the overall length of the hull, with the shape of the mono hull portion varying over its length, generally changing from convex to concave. Catamaran sponsons begin approximately at a point 20-30% from the plumb bow, although this can be varied, develop their full shape by 30-40% aft of the bow and extend to the stern of the boat.

Figure 6:
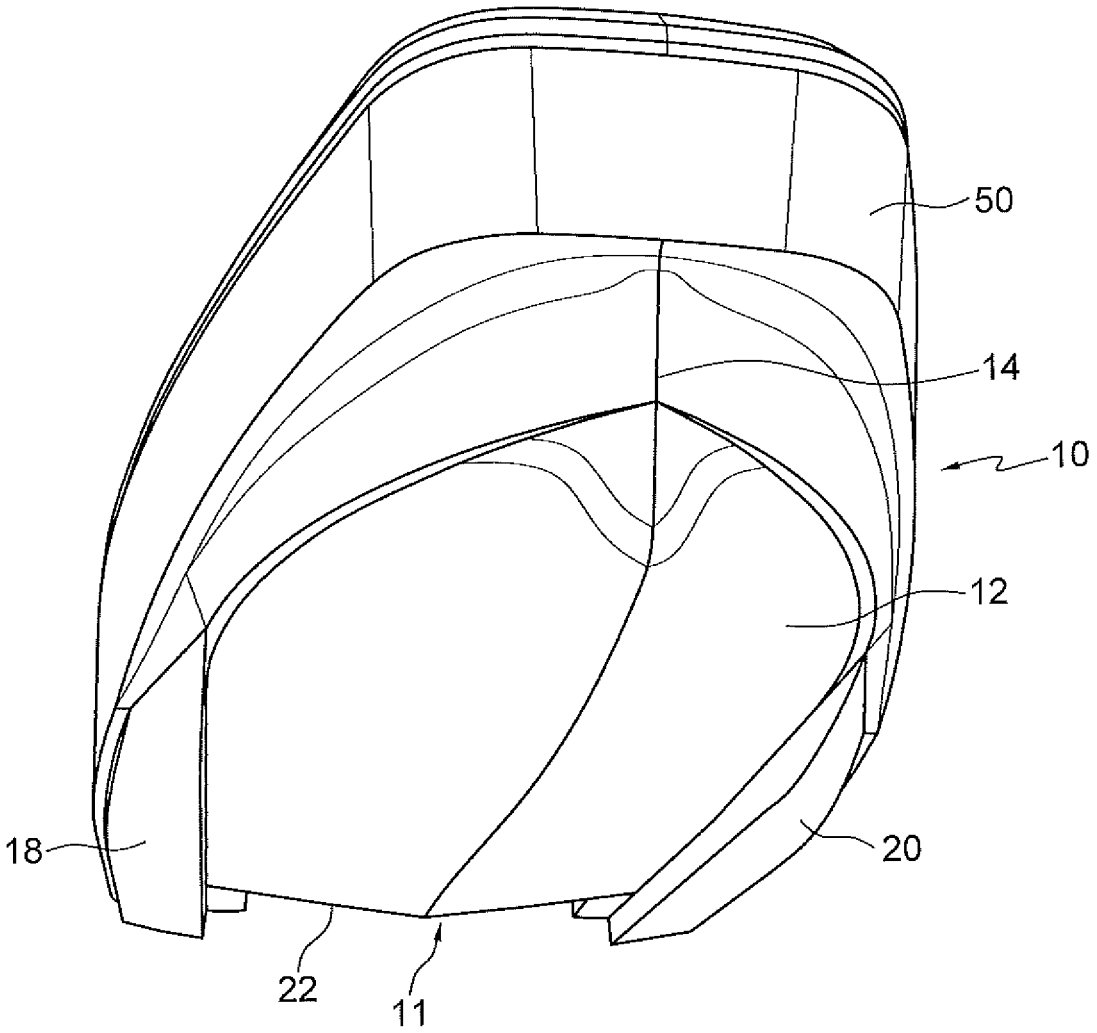
FIG. 6 is a perspective view of the hull configuration from a forward angle showing the catamaran sponsons.
Figure 7:
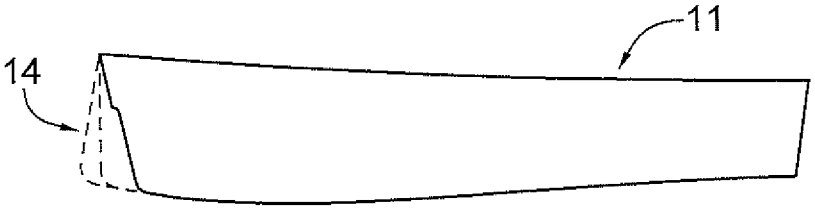
FIG. 7 is a profile view of the plumb bow of the hull configuration.
Figure 13:
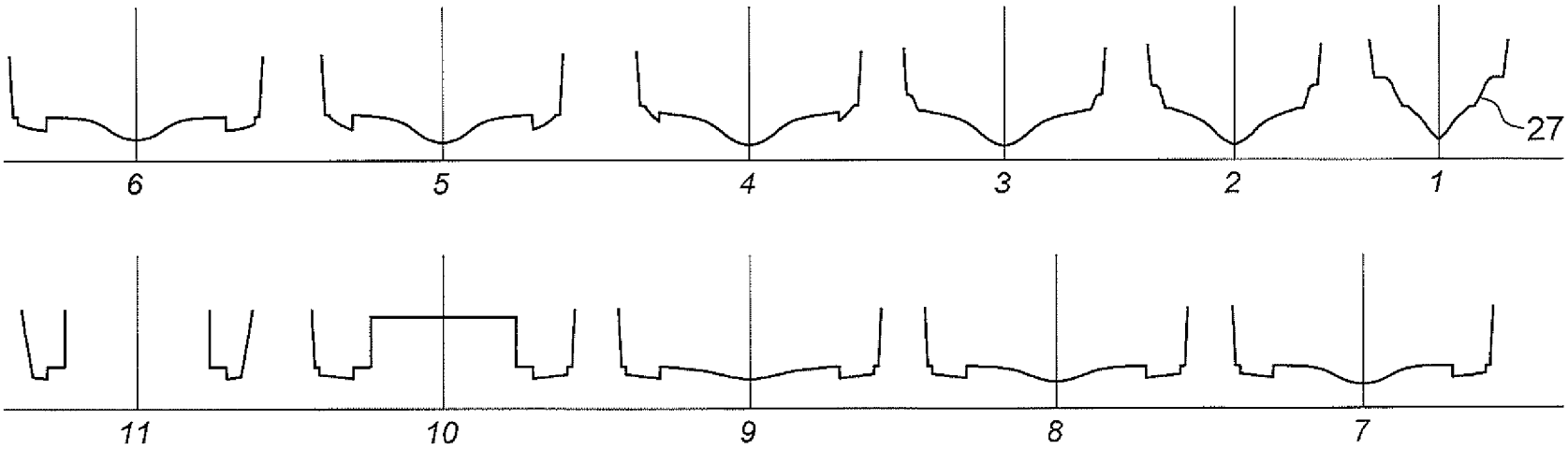
FIG. 13 is a series of cross-sectional views of the hull at one foot intervals from the bow.

FIG. 6 shows a tender 10 with a hull 11 comprising a mono hull portion 12 extending from a plumb bow 14 aft of the boat, with outboard catamaran sponsons 18, 20 extending to the stern 22 of the boat. The plumb bow 14 extends vertically, extending the water line length, i.e., below the water line, some distance. It permits blade shaped water entry which reduces spray and drag as well as providing a softer ride in choppy seas. This portion of the hull, shown at 27 in FIG. 13, is approximately one foot in from the plumb bow. The angle in the preferred embodiment ranges plus or minus 10 degrees from the vertical, as shown in FIG. 7.

Figure 8A:
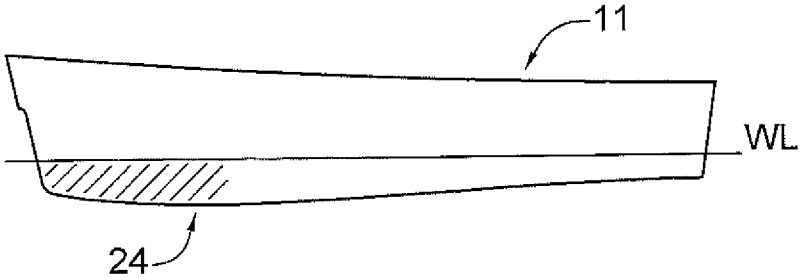
FIG. 8*a* is a profile view of the deep forefront portion of the hull configuration.
Figure 8B:
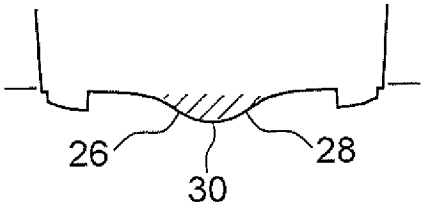
FIG. 8*b* is a cross sectional view of the deep forefront portion.

The shape of the hull in the first 20-30% thereof from the plumb bow 14 is referred to as a deep hull forefoot 24, below the water line, reference WL, having opposing slightly concave portions 26, 28 and a central portion 30, as shown in FIGS. 8*a* and 8*b*. This hull shape in effect opens the waves, which allows an air/water mix to flow into the hull shape directly aft. This air/water mix is less dense than unaerated water, producing a cushioning and lower gravitational force effect when running over choppy seas. Further, the aerated water reduces the wetted surface of the hull and thus reduces hydrodynamic drag. The resulting effect allows for greater efficiency and speed. The deep forefoot 24 begins at the bow, extending below the water line, typically 35-55% of the height of the bow above the water line. Its volume varies, supporting 10-20% of the weight of the boat at rest. The cross-section of the hull, as it changes aft from the plumb bow to the stern is shown in the sequence of cross sections, in feet, in FIG. 13.

Figure 9A:
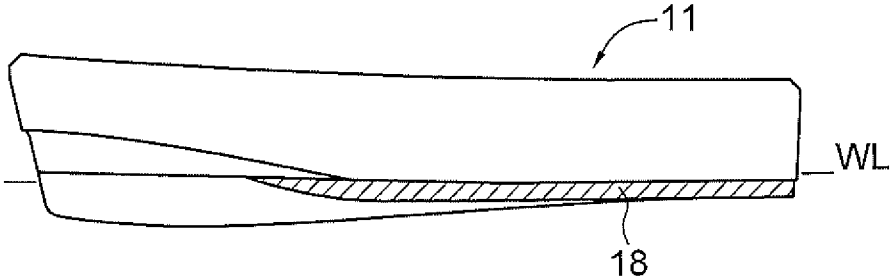
FIG. 9*a* is a profile view of the hybrid hull showing the catamaran sponson locations.
Figure 9B:
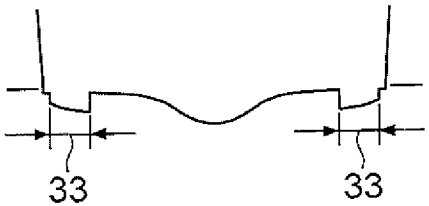
FIG. 9*b* is a cross sectional view of catamaran sections.

Aft of the deep hull forefoot section, the catamaran hull sponsons 18, 20 begin as shown in FIGS. 6, FIGS. 9*a*, 9*b* and the sequence of cross sections of FIG. 13. The catamaran sponsons blend into the hull approximately 20-30% from the stem, i.e. the plumb bow of the tender, and develop their full configuration aft 30-40% along the chine of the tender. The beam of each catamaran sponsons is approximately 18-25% of the half beam dimension of the hull, referred to at 33 in FIG. 9*b*. The depth of the sponsons increase to approximately 10-15% of the hull's half width, again as shown in FIG. 9*b*. The catamaran sections with the indicated dimensions provide excellent stability both at rest and at speed. The inboard wall of each sponson additionally captures the aerated water flow from the deep forefoot portion, which again allows for a soft, low gravitational ride at speed.

Figure 12:
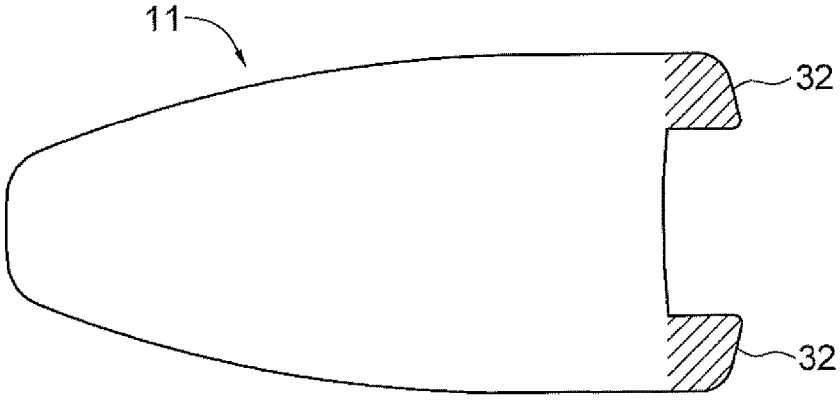
FIG. 12 is a simplified view of the catamaran sponson extended beyond the inner hull.

The catamaran sponsons 18, 20 extend beyond the end of the mono hull portion 12, approximately 8-15% of the overall hull length. This is shown in cross section in FIG. 13 and FIG. 12 at 32 and is referred to as hull sponson extensions. The FIG. 13 cross section at 11 feet from the bow shows only the catamaran sections, past the end of the mono hull. This hull shape extension of FIG. 12 is particularly important in boats as moving the transom forward moves the engine weight and typical passenger load closer to the center of buoyancy. This weight shift improves performance and eliminates backwash over the transom as the reserve buoyancy lifts the transom over incoming waves at rest. The depth of each extension will typically follow the hull's sheer lines, bottom and chines.

Figure 10A:
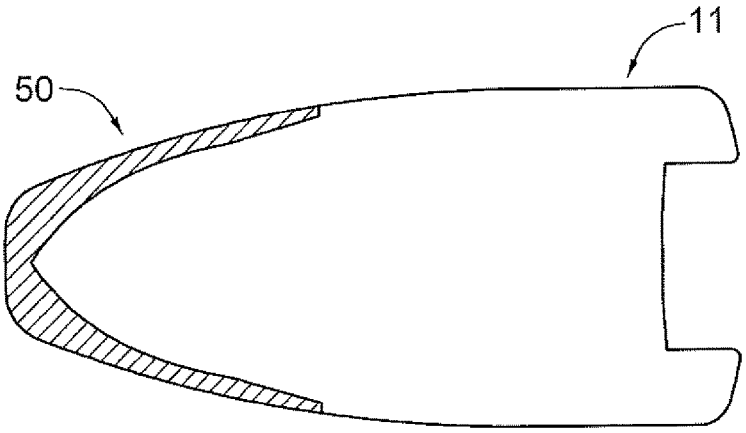
FIG. 10*a* is a plan view of the semi-square bow hull configuration.
Figure 10B:
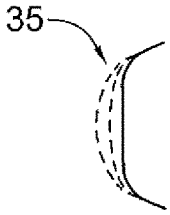
FIG. 10*b* shows a range of arc of the semi-square bar.
Figure 11A:
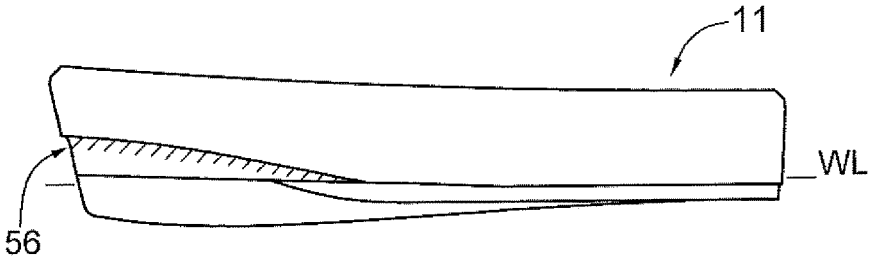
FIG. 11*a* is a profile view of the overhang of the bow.
Figure 11B:
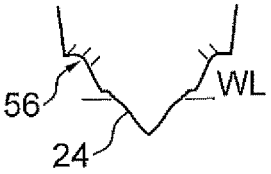
FIG. 11*b* is a cross section of FIG. 11*a*.

Above the plumb bow 14 is a semi-square bow portion 50 shown in FIGS. 10*a* and 10*b*, approximately 30-40% of the width of the hull. The bow portion 50 is termed semi-square as it typically has a small radius are of 10-20% of the width from a flat surface, as shown by two dotted lines 35 in FIG. 10*b*. The semi-square shape in function creates an over-sized spray and lifting chine directly above the deep forefoot portion, as shown in FIGS. 11*a* and 11*b* at 56, which greatly reduces the spray while also lifting the bow over larger waves and provides a stable platform when the tender is nosed into a dock. The semi-square bow will typically be 30-45% of the hull's width.

The new tender hull design described and shown provides a significant stability in a catamaran hull shape, providing a soft ride in choppy seas with limited spray at speed. The tender has a large interior volume with uninterrupted floor space, as shown FIG. 2. Buoyancy is provided at the stern to eliminate flooding of the transom and backwash issues on a relatively small tender or boat.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A hybrid catamaran, comprising:

a boat structure, having a rigid hull;

a plumb bow portion at a front of the rigid hull, extending vertically at least to the water line when the hybrid catamaran is on the water, wherein the hull extends rearwardly from the plumb bow portion in a mono hull configuration; and a pair of outboard catamaran sponsons positioned on lateral opposite side portions of the rigid hull, wherein the sponsons begin at a point 20-30% rearward from the plumb bow extending to the stern of the boat and defining a length of the sponsons, and wherein each sponson has a bottom surface that is flat across a width of the sponson along at least a portion of the length of the sponson.

2. The hybrid catamaran of claim 1, wherein the sponsons have their full configuration 30-40% along a chine of the boat.

3. The hybrid catamaran of claim 1, wherein each catamaran sponson has a width of 18-25% of half of beam width of the hull.

4. The hybrid catamaran of claim 1, including a square bow portion above the plumb line bow portion.

5. The hybrid catamaran of claim 1, wherein the catamaran sponsons extend 8-15% of the hull length beyond a transom portion of the hull.

6. The hybrid catamaran of claim 1, wherein the mono hull configuration is initially convex but changes to concave along the length of the hull.

7. The hybrid catamaran of claim 1, wherein the mono hull includes a deep full forefoot portion 20-30% of the hull from the plumb bow portion.

8. The hybrid catamaran of claim 1, wherein the bottom surface of each sponson is convexly curved downward in a direction of the length of the sponson.

9. The hybrid catamaran of claim 1, wherein the flat of each bottom surface is oriented laterally horizontal when the boat is on the water.

10. The hybrid catamaran of claim 1, wherein the flat of each bottom surface is oriented at an upward angle from an inside lateral edge of the sponson to an outer lateral edge of the sponson.

11. The hybrid catamaran of claim 1, wherein each sponson has an inwardly facing surface that is vertically flat along an inward height of the sponson between the bottom surface and the rigid hull and extends along at least a portion of the length of the sponson.

12. The hybrid catamaran of claim 11, wherein the inwardly facing surface of each sponson is linear along a majority of the length of the sponson.

13. The hybrid catamaran of claim 1, wherein each sponson has an outwardly facing surface that is vertically flat along an outward height of the sponson between the bottom surface and the rigid hull and extends along at least a portion of the length of the sponson.

14. The hybrid catamaran of claim 13, wherein the outwardly facing surface of each sponson is convexly curved outward in a direction of the length of the sponson.

* * * * *